US005628467A

United States Patent [19]

Graveman

[11] Patent Number: 5,628,467

[45] Date of Patent: May 13, 1997

[54] HAMMERMILL WITH INTERSTICED MULTILENGTH HAMMERS

[75] Inventor: Donald F. Graveman, St. Charles, Mo.

[73] Assignee: Magnatech Engineering, Inc., Tonganoxie, Kans.

[21] Appl. No.: 277,327

[22] Filed: Jul. 19, 1994

[51] Int. Cl.[6] ..... B02C 13/04

[52] U.S. Cl. ..... 241/88.4; 241/194; 241/243

[58] Field of Search ..... 241/86, 86.2, 87.1, 241/88, 88.3, 88.4, 194, 243

[56] References Cited

U.S. PATENT DOCUMENTS

| | | | |
|---|---|---|---|
| 1,801,604 | 4/1931 | Jamison | 241/87.1 |
| 2,644,644 | 7/1953 | West . | |
| 2,669,271 | 2/1954 | Treckmann | 241/243 X |
| 2,756,002 | 7/1956 | Brake . | |
| 2,822,138 | 2/1958 | Olive | 241/88 X |
| 3,224,688 | 12/1965 | Beiter . | |
| 3,396,914 | 8/1968 | Liebman | 241/243 |
| 3,610,544 | 10/1971 | O'Connor . | |
| 3,637,144 | 1/1972 | Smith | 241/100 |
| 3,685,437 | 8/1972 | Panning | 100/45 |
| 3,815,521 | 6/1974 | Panning | 100/8 R |
| 4,049,206 | 9/1977 | Konig et al. | 241/73 |
| 4,166,583 | 9/1979 | Ruckstuhl | 241/73 |
| 4,203,755 | 5/1980 | Ruckstuhl . | |
| 4,560,110 | 12/1985 | Burda | 241/36 |
| 4,603,816 | 8/1986 | Panning | 241/266 |
| 4,739,939 | 4/1988 | Panning | 241/294 |
| 4,778,114 | 10/1988 | Panning | 241/37 |
| 4,793,561 | 12/1988 | Burda | 241/36 |
| 4,953,794 | 9/1990 | Paoli | 241/24 |
| 5,062,575 | 11/1991 | Barnabie et al. | 241/73 |

*Primary Examiner*—John Husar

*Attorney, Agent, or Firm*—Litman, McMahon and Brown, L.L.C.

[57] ABSTRACT

A hammermill-type shredding apparatus having a rotor assembly disposed in a housing, the rotor assembly including hammer elements of longer and shorter lengths mounted in an intersticed or alternating manner thereon, a grate having thicker and thinner portions in like alternating manner so as to accept longer length hammers adjacent the thinner portions of the grate and between the thicker portions of the grate, the housing further provided with a comb assembly having finger portions extending into the circle defined by the hammers when in operation, and further extending between the hammer elements so as to remove and prevent any undesirable materials accumulations.

18 Claims, 2 Drawing Sheets

HAMMERMILL WITH INTERSTICED MULTILENGTH HAMMERS

TECHNICAL FIELD

This invention generally pertains to materials shredding apparatus, and more particularly to apparatus and equipment having a revolving rotor and grate for shredding materials.

BACKGROUND ART

Shredding apparatus of various types are generally known in the art of materials processing, and are useful in numerous applications. These types of apparatus include, among others, hammermills. As generally understood in the art, hamermills include a rotor assembly rotatable about an axis which is generally horizontally disposed. The rotor assembly is typically driven by either electric motors or from internal combustion engines. Hammers are affixed to the rotor so as to describe a circle when the rotor is revolving. A grate, which is co-axial with the rotor axis, is typically semi-circular in shape and generally disposed in the lower half of the hammer circle. The grate is spaced away from the hammer circle so as to provide clearance from the moving hammers while also applying a cutting or shredding action to material coming between the hammers and the grate. Material to be shredded or reduced is typically delivered to the shredding apparatus by gravity feed or by mechanical means such as a conveyor belt, or air-driven or other force-feeding means. The material is thereby shredded, being broken up or reduced in size and exits the apparatus through openings in the grate.

Hammermills as described above are readily manufactured in a wide range of sizes and capacities, and are especially suitable for high capacity applications where it is desired to reduce large volumes or masses of material in a short space of time. For example, the hammermill may be adapted to reduce heavy or high-mass-to-volume materials such as automobile tires, or to relatively light, low-mass-to-volume materials such as aluminum scrap or residential refuse. However, difficulties have arisen in the application of hammermill apparatus.

When reducing heavy or tough materials such as automobile tires, the hammermill typically suffers a high degree of wear to both the hammers and the grate. In these applications, the hammermill components are often subject to a high degree of shock, since the materials being reduced are relatively high-strength and durable. For example, automobile tires often contain nylon, polyester or steel belts throughout the body of the tire, and these materials, as well as the rubber from which the tire body is formed, are designed to be strong and resistant to either breakage or cutting. Typically, the hammermill components are formed of steel and may be hardened or provided with a case-hardened surface to improve the strength and wear resistance of the components.

Another phenomenon known generally as windage affects the operation of the hammermill apparatus primarily in the reduction of relatively lighter materials. Windage refers to the flow of air generated by the relatively high-speed rotation of the rotor. Generally, this airflow tends to undesirably slow the flow of the material into the hammermill, and may cause a backup of infed material at the hammermill inlet. Furthermore, windage may cause a circular flow of material within the hammermill itself, which can substantially reduce the capacity of the apparatus. Either flow condition can cause the apparatus to function in an undesirable manner, causing the infed material to enter the apparatus in slugs, resulting in uneven operation or even plugging and stopping of the rotor in some instances. Such flow conditions as these can cause substantial damage to the hammermill apparatus, but in any event reduce the effective capacity of the apparatus.

The flow of material within the typical hammermill apparatus is also affected during the ongoing operation of the apparatus by the undesirable accumulation of material within and between the components of the apparatus. In practice, it is typical for a portion of the material to become compacted between the hammers of the rotor assembly, interfering with the flow of material within the hammermill apparatus. Obviously, this packed material also reduces the available material flow area within the hammermill apparatus, sometimes to the extent that the apparatus is virtually unable to process the materials. This problem is exacerbated with material which is lightweight and relatively easily crushed or compacted, an example of which is the aluminum can in common use for containing consumer goods such as cola or soda, since this material is also more subject to the effects of windage. Other materials which present similar difficulties are such thin, flexible materials as paper, corrugated stock, wood veneers and sheet metals. Such material tends to be readily formed, and under the impact of the hammer element, will be formed onto the hammer element. The material can then build up in layers on the hammers and become compacted between the hammers of the rotor assembly, interfering with the flow of material within the hammermill apparatus. Obviously, this packed material also reduces the available material flow area within the hammermill apparatus, sometimes to the extent that the apparatus is virtually unable to process the materials.

In the typical rotor assembly, the rotor includes a rotor provided with a number of hammer elements affixed thereto. As the apparatus is operated for extended periods, portions of the materials reduced in the hammermill tend to accumulate between the hammer elements. This accumulation, as it increases, concurrently reduces the material flow capacity of the apparatus. At some point, the apparatus must be stopped and the accumulation must be manually removed from the rotor assembly before operation can be successfully resumed.

The effects of the windage in causing slugs of the infed material to enter the apparatus, in combination with the compaction effect of the materials within the rotor assembly and, in some cases, in the grate assembly as well, can necessitate fairly frequent shutdowns of the apparatus for cleaning and removal of the accumulated material. Such cleanings are arduous and time-consuming and therefore relatively expensive in terms of labor costs alone, and substantial costs may be incurred due to loss of business and other downtime costs as well.

Therefore, it is an object of the present invention to provide a hammermill apparatus as will operate to efficiently reduce readily compacted or compressed materials.

It is another object of the present invention to provide a hammermill apparatus such as will reduce such materials while incurring little or no accumulation of the materials in the hammermill apparatus.

It is yet a further object of the present invention to provide such a hammermill apparatus as will be relatively inexpensive to repair and maintain.

It is another object of the present invention to provide such a hammermill apparatus as will be relatively simple and cost-effective to manufacture.

These and other objectives of the present invention will become apparent in the specification and claims that follow.

SUMMARY OF THE INVENTION

The subject invention is a hammermill apparatus for reducing material therein. The hammermill apparatus has a rotor assembly rotatably disposed in a housing, and a grate assembly disposed co-axially therewith. The rotor assembly includes a series of hammer elements of longer and shorter lengths disposed in an alternating arrangement such that each longer hammer element is disposed adjacent a shorter hammer element. Likewise, each grate element is provided with thicker and thinner portions in an alternating arrangement, so that each longer length hammer element can pass adjacent a thinner portion of the grate element and between thicker portions of the grate element, while each shorter length hammer element passes adjacent a thicker portion of the grate element. A comb assembly is also provided, the comb including finger elements which extend into the circle defined by the hammer elements when the rotor assembly is rotating, and extend between the respective hammer elements.

DESCRIPTION OF THE PREFERRED EMBODIMENT

Figure 1:
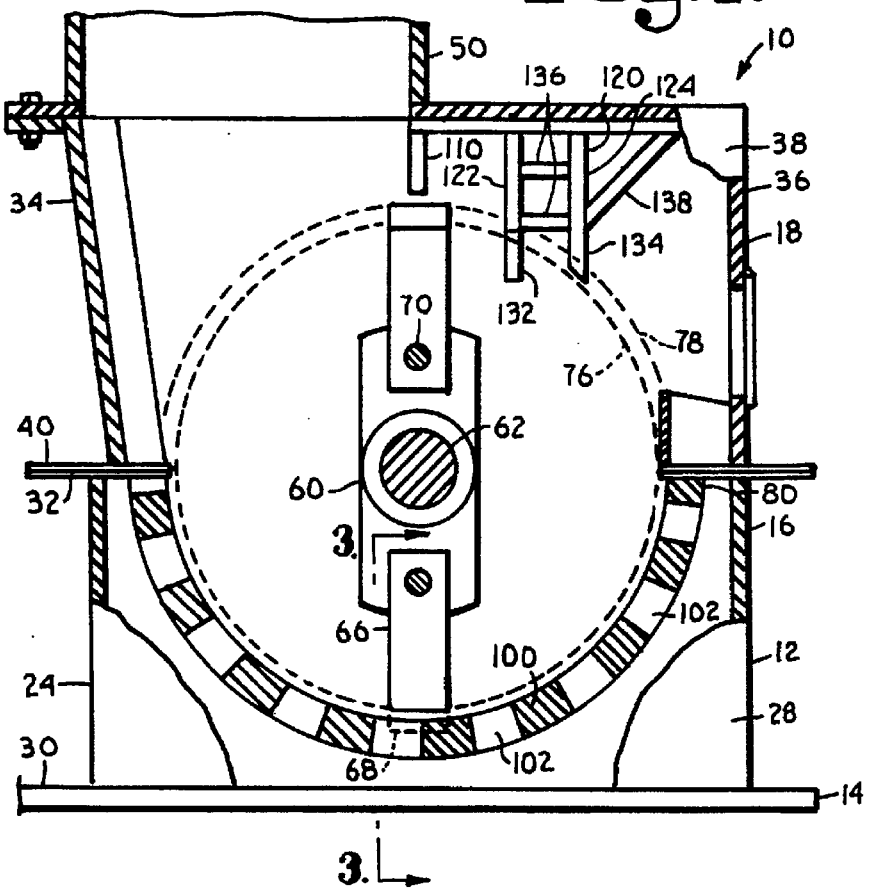
FIG. 1 shows a cross-sectional view of a hammermill apparatus according to the present invention.
Figure 2:
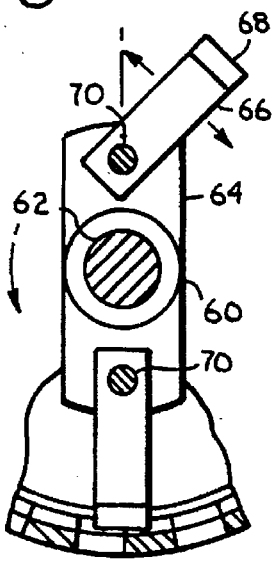
FIG. 2 shows a partial cross-sectional view of the rotor assembly of the hammermill apparatus of FIG. 1.

A shredding or hammermill apparatus generally according to the present invention is shown in FIG. 1 and referred to with reference number 10. The hammermill apparatus 10 is preferably vertically oriented as shown in FIGS. 1 and 2, so that the designations of top, bottom, upper and lower will be understood to relate to the invention as it is preferably practiced. However, any designations relating to front, rear, right or left will be understood to be relative to the drawings herein as an aid in description only.

The hammermill apparatus 10 includes a housing 12 which has as the bottom a base or pedestal 14. The pedestal 14 is a generally horizontal structure which may include a frame, means for securing the hammermill apparatus in a selected position and location, and means for connecting the hammermill apparatus 10 to other apparatus. There may also be included on the pedestal 14 such features as parallel beams on the underside thereof which may serve as skids and attachment points for connecting cables and other lifting or moving means to the hammermill apparatus 10. These features are not shown, and are considered to be known to those skilled in the relevant arts. The pedestal 14 also defines an aperture (not shown) for permitting material flow from the housing 12.

The hammermill apparatus 10 includes a housing 12 which includes a lower housing portion 16 and an upper housing portion 18. The housing 12 is preferably substantially rectangular in both cross-section and footprint. The bottom side of the lower housing portion 16 affixed to the pedestal 14 in order to enhance the stability and rigidity of the hammermill apparatus 10. The lower housing portion 16 is defined by a front lower exterior surface 24, a rear lower exterior surface 26 and connecting lower side surfaces 28. All these surfaces are generally vertically disposed planar surfaces, extending upward from the bottom side 30 of the housing 12 to an upper face 32 of the lower housing portion 16.

The upper face 32 of the lower housing portion 16 is preferably a generally planar lip extending about the upper edge of each of the sides 24, 26 and 28 of the lower housing portion. This lip 32 forms a supporting surface for the upper housing portion 18 so that the weight thereof is borne by the lower housing portion 16.

As with the lower housing portion 16, the upper housing portion 18 is defined by a front upper exterior surface 34, a rear upper surface 36 and connecting upper side surfaces 38. All these surfaces are generally vertically disposed planar surfaces, extending upward from the lower surface 40 of the upper housing portion 18 to the top 42 of the housing 12. The lower surface 40 of the upper housing portion 18 is preferably a generally planar lip extending around the perimeter of the upper front, rear and connecting sides 34, 36 and 38, respectively, and sized to substantially match the upper surface or lip 32. The upper housing portion 18 thus rests on and is supported by the lower housing portion 16 when the hammermill is in the operational condition.

The upper housing portion 18 and the lower housing portion 16 need not be the same height, as shown herein. In fact, a unitary or one-piece housing 12 may be employed. However, it is preferable to employ a housing having such separable housing portions 16 and 18 to improve ease of maintenance and cleaning.

On the top 42 of the housing 12 is an infeed conduit 50. The infeed conduit 50 may be tubular in shape, but is preferably rectangular so as to feed materials through an aperture in the top surface and into the hammermill apparatus 10 in a relatively even manner. According to the preferred embodiment, the infeed conduit 50 is disposed adjacent the front upper exterior surface 34 and has a front-to-rear depth equal, for example, to one-half of the front-to-rear depth of housing 12, and a width substantially equal to the width defined between the connecting sides 38. Preferably, the infeed conduit 50 may be attached to means of supplying material to the hammermill apparatus 10 such as a gravity fed material supply conduit, hoppers, or continuous belt, vibrating pan or other material conveyance means. The material supply means are not shown and do not comprise any part of the present invention.

Housed in the interior of the hammermill apparatus is a rotor assembly 60. The rotor assembly 60 includes a rotor axle 62, one or more hammer arms 64 secured to said 10 rotor axle 62, and at least two hammer elements for each arm 64, a first, relatively shorter hammer element 66 and a second, relatively longer hammer element 68. Each hammer element 66 and 68 is secured to the hammer arm 64 by a hammer link pin 70, which permits each hammer element 66 and 68 to pivot with respect to the hammer arm 64. The rotor axle 62 is disposed generally horizontally on bearing means affixed within the housing 12 on an axis which is parallel to and approximately mid-way between the front lower exterior surface 24 and the rear lower exterior surface 26, and is preferably substantially aligned with the upper face 32 of the lower housing portion 16.

The hammer element arrangement shown is exemplary and those skilled in the art will understand that the rotor assembly may be provided with additional hammer elements of relatively longer or shorter lengths. According to the preferred embodiment, however, the first and second hammer elements are disposed on the link pin 70 in an alternating arrangement as shown.

A prime mover is operatively connected to the rotor axle 62, either by belts, chain drive, gearing or direct drive, as a means of rotating the rotor assembly 60 during the operation of the hammermill apparatus 10. Neither the bearing means nor the means of rotating the rotor assembly 60 is shown or described herein. Common bearings such as roller or sleeve bearings, for example, and motors such as, for example, electric motors or internal combustion engines are suitable for use in the hammermill assembly 10. These are believed to be well understood by those skilled in the relevant art and are not in themselves part of the present invention.

When the short hammer element 66 is pivoted on the hammer link pin 70 to full extension with respect to the rotor axle 62, the hammer arm 64 and short hammer element 66 define the radius of a first rotor circle 76. Likewise, when the long hammer element 68 is pivoted on the hammer link pin 70 to full extension with respect to the rotor axle 62, the hammer arm 64 and the long hammer element 78 define the relatively larger radius of a second rotor circle 78. This condition is shown in FIG. 1, with the respective rotor circles 76 and 78 shown in dashed outline. This is the normal condition during rotation of the rotor assembly 60.

Turning now to FIG. 2, the pivoting action of the respective hammer elements 66 and 68 about the hammer link pin 70 can be seen. In drawing FIG. 2, the hammer elements 66 and 68 on one hammer link pin 70 are shown pivoted in the clockwise direction. As the rotor assembly 60 is rotated in the counterclockwise direction, a hammer element 66 or 68 would pivot in the clockwise direction when encountering material which could not be readily broken or reduced under the impact of the hammer element 66 or 68. While both hammer elements 66 and 68 are shown as pivoted, either hammer element 66 or 68 is preferably independently pivotally mounted on the hammer link pin 70. This permits each hammer element 66 or 68 to respond independently to the infed material in the housing 12 when the rotor assembly 60 is rotating. Likewise, the pivoting action of the hammer elements 66 and 68 is preferably relatively free so that the hammer element 66 or 68 will return to the fully extended position after pivoting away therefrom.

Returning again to FIG. 1, a grate assembly 80 which is contained within the housing 12 can be seen. The grate assembly 80 includes a semicircular track or rail 82 fixed to the connecting sides 28 of the lower housing portion 16. The semicircular track or rail 82 defines an upwardly opening semicircle having a diameter slightly larger than that of the first rotor circle 76.

The grate assembly 80 is assembled from a plurality of generally horizontally disposed grate bars 100. Each grate bar 100 is separated and spaced apart from the next respective grate bar 100 by a spacer 102 disposed therebetween. The spacers 102 separate the grate bars 100 from each other along the direction of hammer rotation. Preferably, two spacers 102 of identical thickness are disposed in the track 82 at each end of the grate bar 100. Two adjacent grate bars 100 and any two of the spacers 102 secured between the two adjacent grate bars 100 define an aperture. However, one or more spacers 102 may also be secured at intervals along the length of the grate bars 100 between the tracks 82, to provide additional support for the grate bars, if desired, and also to divide the aperture between the two adjacent grate bars 100 into a number of smaller apertures of a selected size. Therefore, a plurality of grate bars 100 and grate bar spacers 102 cooperate to define a relatively large number of apertures in the grate assembly 80.

While the spacers 102 can be distinct and separate from the grate bars 100, it may be preferable to form the grate bars 100 with integral spacers 102 in order to assure the desired spaced relationship between the spacers 102 and the grate bars 100. Integral spacers 102 can reduce the downtime and maintenance requirements of the grate assembly 80, as well.

A windage screen 110 extends into the interior of the housing 12 from the top surface 42. The windage screen 110 is preferably a flat plate which interferes with any circular airflow pattern which would otherwise be generated circumferentially around the second rotor circle 78 by the rotation of the rotor assembly 60. The affects of windage are reduced at the location of the infeed conduit 50 to the extent the circular airflow pattern is disrupted, although the windage screen does not substantially disrupt any airflow patterns generated within the periphery of the second rotor circle 78.

A comb assembly 120 affixed to the top 42 of the housing 12 extends into the interior of the housing 12. This comb assembly 120 preferably includes a first comb element 122 and a second comb element 124. As shown, the comb elements 122 and 124 depend vertically from and are affixed to the top 42, and are approximately the same length, each extending into the second rotor circle 78. The first comb element 122 is spaced apart from and in front of the second comb element 124 so that at least the first comb element extends also into the circumference of the first rotor circle 76. In this configuration, the second comb element 124 also acts as a windage controller to minimize or substantially prevent peripheral windage generation. So as to avoid contact with the hammer elements 66 and 68 which rotate in and define the respective rotor circles 76 and 78, the first and second comb elements 122 and 124 also preferably include first and second comb element end or finger portions 132 and 134, respectively. Each of the first comb fingers 132 is spaced apart from the next adjacent first comb finger 132 so as to provide sufficient space for each of the first and second hammer elements 66 and 68 to pass therebetween in an intersticed manner without contacting the first comb fingers 132. Likewise, each second comb fingers 134 is spaced apart from the next adjacent second comb finger 134 so as to provide sufficient space for each of the hammer elements 66 to pass therebetween without contacting the second comb fingers 134.

To ensure stability of the first comb 122 and the second comb 124, a series of generally horizontal, parallel interconnecting cross braces 136 adjoin the first comb 122 and the second comb 124. An additional angle brace 138 is shown extending from the second comb 124 to the top 42. The cross braces 136 and angle brace 138 shown are considered exemplary, and those skilled in the relevant art will understand that either additional or fewer braces may be employed and that the locations may be altered without substantially changing the nature of the comb assembly 120.

Figure 3:
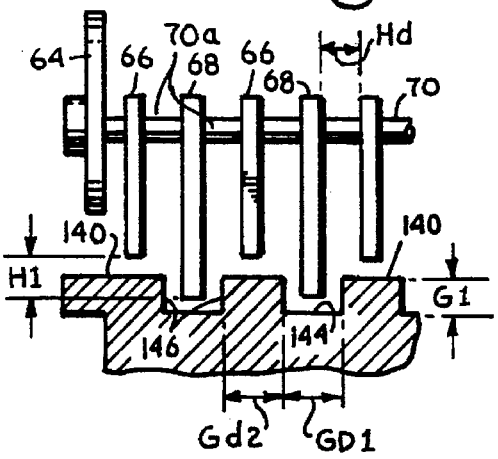
FIG. 3 shows a partial cross-sectional view of the rotor assembly and grate element of the hammermill apparatus of FIG. 1 taken along Section line 3—3 of FIG. 1.

Turning now to FIG. 3, the rotor assembly 60 is seen, in part, with a corresponding grate bar 100 portion. The view in FIG. 3 is exemplary of the preferred conformation of the grate bar 100 and of the preferred disposition of the hammer elements 66 and 68 on the hammer link 70. Exemplary hammer spacers 70*a* are shown on the hammer link pin 70 between the first hammer element 66 and the second hammer element 68, and between the second hammer element 68 and the next first hammer element 66. Preferably, the alternating disposition of first and second hammer elements 66 and 68 continues the length of the pin 70, with each first hammer element 66 next adjacent a second hammer element. The preferred length of the pin 70 is substantially the width of the housing 12. The hammer spacers 70*a* ensure that the desired hammer spacing Hd is maintained between the respective hammer elements 66 and 68. The difference in length between the respective hammer elements 66 and 68 is defined as H1.

The preferred grate bar 100 includes a first cutting edge 140 disposed adjacent the first rotor circle 76. A series of spaced apart recesses are also defined in the cross-section of the grate bar 100. Each recess is defined by a second cutting surface 144 which is parallel to the first cutting surface 140 and recessed preferably by a distance G1 which is equal to the difference in length H1 of the hammers 66 and 68. Each recess also preferably includes two parallel sidewalls 146 which are spaced apart from each other by a distance Gdl equal to the thickness of a hammer element 66 or 68 and the distance Hd between the hammer elements 66 and 68. In order to ensure passage of the long hammer elements 68 centrally between the sidewalls 146, the recesses are also spaced apart by a distance Gd2, so that each first cutting surface 140 and each second cutting surface 144 is desirably of the same length, with Gdl and Gd2 equal. Those skilled in the art will understand that Gdl and Gd2 need not be equal either to each other or to the sum of the hammer thickness and spacing Hd, and that the depth of the recess G1 need not equal the hammer length difference H1. Furthermore, alternate grate bars 100 having only the surface 144 may be employed at one or more locations in the grate assembly 80. Those skilled in the relevant art will also understand that the conformation of the grate bar 100 can be altered to conform to other arrangements of hammer elements, or to hammer element arrangements of other longer or shorter length.

Maintenance, replacement or removal of the grate bars 100 is accomplished by sequentially moving the grate bars on the track or rail 82 to remove the grate bars 100 and then sequentially reinstalling the grate bars 100 on the track or rail 82 and returning the grate bars 100 to the desired position.

In an exemplary hammermill apparatus 10, virtually all components will be fabricated from steel, with case or other hardening means employed to improve the durability of the hammer elements 66 and the grate bars 100. High strength steel alloys may also be employed in the fabrication of the hammer elements 66 and the grate bars 100 to further enhance durability of the hammermill apparatus 10 and to reduce the number of stops and teardowns required for maintenance.

In operation of the hammermill apparatus 10, the prime mover is actuated to cause counterclockwise rotation of the rotor assembly 60. Rotation of the rotor assembly 60 causes the hammer elements 66 to pivot centrifugally outward with respect to the rotor axle 62 to their maximum radial extension. Material to be reduced is then fed into the housing 12 through the infeed conduit 50. Under the influence of both gravity and the momentum imparted by the rotation of the hammer elements 66 and 68, the infed material impinges the grate assembly 80.

Each first hammer element 66 strikes a portion of the material against a corresponding first cutting surface 140 and each second hammer element 68 strikes a portion of the material against a corresponding second cutting surface 144 of a grate bar 100. The second hammer element 68 may also cause a portion of the material to be stricken across one or both of the sidewalls 146. Portions of the infed material which have been reduced in size or consistency by being stricken between the hammer elements 66 and 68 and one or more of the grate bars 100 then traverse the apertures defined in the grate assembly 80 and exit the housing 12 through the aperture defined in the pedestal 14.

Portions of the material which have been reduced also become compacted between adjacent hammer elements 66 and 68, and therefor do not proceed through the apertures in the grate assembly 80. However, the rotation of the rotor assembly 60 carries the hammers 66 and 68 between which the material is lodged past the grate assembly 80 and into the comb assembly 120.

As the hammer elements 66 and 68 pass the comb assembly 120, the fingers 134 and then the fingers 132 extend between the hammer elements 66 and 68 in an intersticed relationship, not contacting the hammer elements 66 and 68, but contacting and dislodging the compacted material. The dislodged material is then carried by the rotor assembly 60 around to the grate assembly 80, where the material again is struck against one or more of the grate bars 100 by the hammer elements 66 and 68. This process is repeated until the material is sufficiently reduced to pass through the grate assembly apertures. Material is therefor unable to compact between the adjacent hammer elements 66 and 68 so as to interfere with with operation of the hammermill apparatus 10.

Figure 4:
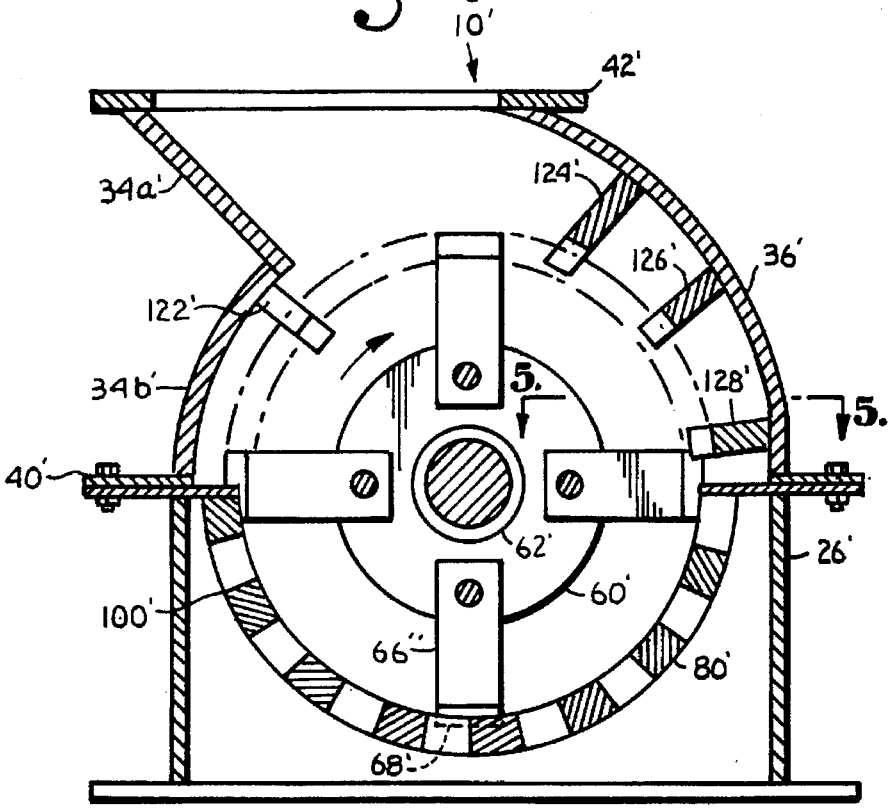
FIG. 4 shows a cross-sectional view of an alternative embodiment of a hammermill apparatus according to the present invention.
Figure 5:
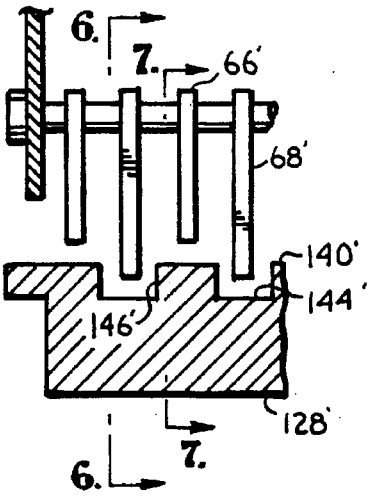
FIG. 5 shows an enlarged partial cross-sectional view of the rotor assembly and grate element of the hammermill apparatus as shown in FIG. 4 taken along Section line 5—5 of FIG. 4.

An alternative embodiment is shown in FIGS. 4 and 5. It should be noted that when the same item or feature is shown in more than one of the figures, it will be labeled with the corresponding reference numeral to aid in the understanding of the subject invention. A prime is added to the reference numerals of the alternative embodiment. Furthermore, reference should be had to all of the figures necessary to aid in the understanding of the specification even where a particular figure is referred to, as all reference numerals are not displayed in all figures in order to minimize confusion and aid in clarifying the subject invention.

The alternative embodiment of the hammermill apparatus 10', as disclosed in FIG. 4, is generally referred to by those skilled in the art as an "uprunning" type hammermill apparatus, as opposed to the embodiment shown in FIG. 1, generally referred to by those skilled in the art as a "downrunning" type hammermill apparatus.

According to the alternative embodiment, the rotor assembly 60' is rotated in the clockwise direction. The upper housing portion 18' is differentiated from the upper housing portion 18 of the first preferred embodiment. In the alternative embodiment, the rear upper surface 36' is curvilinear about the axis of the rotor axle 62', substantially in the form of a portion of a spiral. The rear upper surface 36' extends from adjacent the rear lower surface to adjoin the top surface 42' approximately in the center of the top 42'. The upper front surface 34' includes a diverting surface 34*a*' adjoining the top surface 42' at the front edge and extending downwardly approximately one-half the height of the upper housing portion and angled inwardly generally toward the axis of the rotor assembly 60'. A curvilinear surface **34*b*' adjoins the lower edge of the diverting surface 34*a*' to the lower edge 40' of the upper housing portion. The variegated front and rear upper surfaces 34' and 36' provide improved windage and material control in the uprunning hammermill apparatus 10'**.

The hammermill apparatus 10' as shown in FIG. 4 also includes four combs 122', 124', 126' and 128'. Each of these combs 122', 124', 126' and 128' is of the same conformation as that described for the grate bars 100 of the primary preferred embodiment.

This conformation is shown in FIG. 5, which is a cross-sectional view of the hammermill apparatus 10' taken along Section lines 5—5 of FIG. 4. This view shows one set of hammer elements 66' and 68' passing the comb 128'. In this embodiment, the combs 122', 124', 126' and 128' do not include any end portions which extend between the short hammer elements 66' and the adjacent long hammer elements 68'.

The combs 122', 124', 126' and 128' each include a comb body portion which extends from the respective housing surface on which the comb is affixed to the second cutting surface 144'. The comb body portions act as integral windage screens and control the movement of material within the housing. In operation, the prime mover rotates the rotor assembly 60' in the clockwise direction. As material is infed through the conduit 50 and into the housing 12, the material is directed under the influence of gravity toward the rotor assembly 60' by the diverting surface **34*a*'. Material approaching the rotor assembly 60' is prevented from falling in the counterclockwise direction by the presence of the first comb 122', which directs the material into the rotor assembly 60'. The hammer elements 66' and 68', operating in a clockwise direction, intercept the downwardly moving material and carry the material in a clockwise direction. As the rotor assembly 60' turns clockwise, the material is transported toward the grate assembly 80', with relatively larger pieces being broken, or "groomed", on the combs 124', 126' and 128'. Transport of the material continues until the material is in the area of the grate assembly, at which point the material is hammered and reduced by the combined action of the hammers and the grate bars 100'**.

The combs 122', 124', 126' and 128' also function to minimize or substantially prevent the generation of windage peripheral to the rotor assembly 60'. Without the first comb 122' in place to control windage, the airflow induced by the rotation of the rotor assembly 60' would be centrifugally directed upward and into the infeed conduit 50'. This airflow, in not inhibited by the combs, would substantially impede the flow of material infed into the housing 12.

Figure 6:
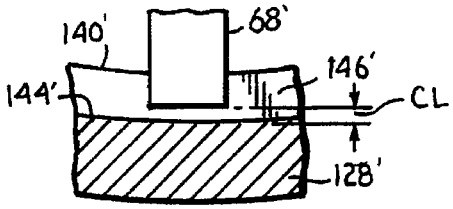
FIG. 6 shows an enlarged partial cross-sectional view of the rotor assembly and grate element of the hammermill apparatus as shown in FIG. 4 taken along Section line 6—6 of FIG. 5.
Figure 7:
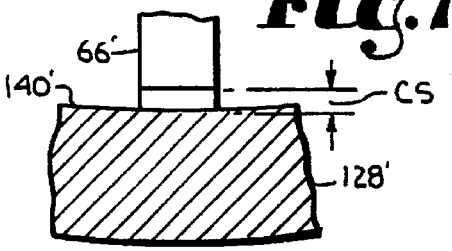
FIG. 7 shows an enlarged partial cross-sectional view of the rotor assembly and grate element of the hammermill apparatus as shown in FIG. 4 taken along Section line 7—7 of FIG. 5.

FIGS. 6 and 7 show partial cross-sectional views of the comb 128' and the long hammer element 68' and the short hammer element 66', respectively. A long hammer clearance Cl is provided between the end of the long hammer element 68' and the second cutting surface 144', as shown in FIG. 6. A short hammer clearance Cs is provided between the end of the short hammer element 66' and the first cutting surface 140'. The hammer clearance Cl and Cs provide running clearance for the hammer elements 68' and 66', but are also relatively small to ensure minimal material passage. Also, the hammer clearance Cl and Cs may be, but need not be equal.

It will be apparent to those skilled in the relevant art that the comb assembly 120 can readily be applied to an up-running hammermill apparatus 10' as shown in the alternative embodiment, and that the combs 122', 124', 126' and 128', or any combination thereof, could be applied equally well to the downrunning hammermill apparatus 10. Also, one or more combinations of combs may be employed with the comb assembly 120. For example, the windage screen 110 in the primary preferred embodiment could be replaced with a comb 122'. The embodiments shown herein are intended to be exemplary rather than limiting.

Those skilled in the relevant art will appreciate the numerous advantages of the hammermill apparatus according to the present invention. By including hammer elements 66 and 68 having two different lengths in an intersticed relationship, the hammermill apparatus 10 ensures that low-density, lightweight or easily compacted materials will be efficiently reduced. The comb or grate bar configuration described herein in conjunction with the multi-length hammers also ensures that such material is unlikely to become compacted between the hammer elements, thus substantially minimizing the possibility of material clogs within the hammermill apparatus 10. Downtime for cleaning and maintenance is therefore substantially reduced. In addition, the comb assembly 120 or the alternative combs 122' provide substantially improved windage control within the housing 12, so that the flow of infed material into and within the housing 12 is not substantially impeded. Furthermore, those portions of the comb assembly 120, grate bar 100 or comb 122' which extend into the periphery of the second rotor circle 78 extend windage control into the rotor assembly 60, thereby substantially enhancing windage control in the hammermill apparatus 10.

Modifications to the preferred embodiment of the subject invention will be apparent to those skilled in the art within the scope of the claims that follow:

What is claimed is:

1. A hammermill apparatus for shredding and reducing materials, said hammermill apparatus comprising:

a housing having a front side, a rear side and connecting sides therebetween defining an interior, and a top surface defining an aperture, said housing further having an upper portion and a lower portion;

an infeed conduit for feeding materials into said housing interior;

a rotor assembly having a first relatively shorter hammer element and a second relatively longer hammer element adjacent said first hammer element;

a grate assembly having a plurality of grate bars; each grate bar being spaced from adjacent grate bars by spaces so as to provide apertures therebetween to allow shredded material of a preselected size to pass during operation between adjacent grate bars and through said grate so thereafter be located on a side of said grate opposite said hammer elements; each of said grate bars having a first cutting surface and a second cutting surface parallel to and spaced away from said first cutting surface; and said first hammer element has an outer end that describes a first circle and said second hammer element has an outer end that describes a second rotor circle when said rotor assembly rotates; said second rotor circle having a relatively larger radius than said first rotor circle; said grate bars first cutting surface being located in close proximity to said shorter hammer first rotor circle and said grate bars second cutting surface being located in close proximity to said longer hammer second rotor circle.

2. The hammermill apparatus as set forth in claim 1 wherein said first cutting surface and said second cutting surface are connected by parallel and spaced apart sidewalls.

3. The hammermill apparatus as set forth in claim 1 wherein said rotor assembly further includes a rotor axle, a hammer arm secured to said rotor axle, and a hammer link pin for securing said first and second hammer elements to said hammer arm.

4. The hammermill apparatus as set forth in claim 1 wherein said rotor assembly further includes a plurality of said first and second hammer elements, each said first hammer element next adjacent one of said second hammer elements.

5. The hammermill apparatus as set forth in claim 4 wherein said hammermill apparatus further includes a comb assembly.

6. The hammermill apparatus as set forth in claim 5 wherein said comb assembly further includes a first comb element and a second comb element, each said comb element affixed to the top of said housing.

7. The hammermill apparatus as set forth in claim 6 wherein said first comb element is spaced apart from said second comb element and extends into said second rotor circle.

8. The hammermill apparatus as set forth in claim 6 wherein said second comb element includes a plurality of comb element end portions, each said comb element end portion adjacent to and spaced apart from the next adjacent said comb element end portion and extending into said first rotor circle for extending between said respective hammer elements in an intersticed manner.

9. The apparatus according to claim 1 wherein a radially outer tip of said relatively longer hammer element extends outward beyond said grate first cutting surface during rotation of said longer hammer element.

10. A hammermill apparatus for shredding and reducing materials, said hammermill apparatus comprised of:

a housing having an upper housing portion and a lower housing portion defining an interior, said upper housing portion including a front upper side, a rear upper side and upper connecting sides therebetween, and a top surface defining an aperture, said lower housing portion including a front lower side, a rear lower side and lower connecting sides therebetween;

an infeed conduit for feeding materials into said housing interior;

a rotor assembly rotatably disposed in said housing, said rotor assembly including a generally horizontally disposed rotor axle, a rotor arm on said rotor axle, and a first relatively longer hammer element and a second relatively shorter hammer element adjacent said first hammer element secured to said rotor arm;

a grate assembly including a plurality of spaced grate bars with apertures therebetween; each grate bar having a first cutting surface radially spaced from said rotor so as to be in close proximity to an arc traveled by a tip of said longer hammer element and a second cutting surface radially spaced outward from said rotor and inward from said first cutting surface so as to be in close proximity to an arc traveled by a tip of said shorter hammer element; said first cutting surface being arced and positioned generally parallel to said first cutting surface; and a comb assembly in said housing interior, said comb assembly including a first comb element.

11. The hammermill apparatus as set forth in claim 10 wherein said hammermill apparatus further includes a windage screen disposed in said housing interior.

12. The hammermill apparatus as set forth in claim 10 wherein one said comb element includes a comb body portion as an integral windage screen for controlling material movement in said housing interior.

13. The hammermill apparatus as set forth in claim 10 wherein said rotor arm further includes a hammer link pin for pivotally securing said first and second hammer elements to said rotor arm.

14. The hammermill apparatus as set forth in claim 13 wherein said rotor assembly further includes a plurality of first hammer elements and a plurality of said second hammer elements pivotally secured to said rotor arm, each said first hammer element next adjacent one of said second hammer elements and each said second hammer elements next adjacent one of said first hammer elements so that said first and second hammer elements are disposed in an alternating arrangement on said hammer link pin.

15. The hammermill apparatus as set forth in claim 14 wherein said each first hammer element is spaced apart from said second hammer element by a hammer spacing Hd.

16. The hammermill apparatus as set forth in claim 15 wherein said hammer spacing Hd is maintained by a hammer spacer between said first hammer element and said second hammer element.

17. The hammermill apparatus as set forth in claim 14 wherein said rotor assembly further includes a plurality of rotor arms.

18. A hammermill apparatus for shredding materials comprising:

housing means forming an enclosure with at least one aperture to allow feeding of the materials to be shredded into said enclosure;

a rotor assembly located within said housing means having a rotatable axle, motor means for rotating said axle and at least one longer hammer element and one shorter hammer element axially spaced, mounted on and extending generally radially outward from said axle; and a grate located within said housing means and spaced radially outward from said axle; said grate having a plurality of grate bars with said bars having a preselected spacing therebetween so as to be adapted to allow shredded materials of a preselected size to pass therebetween; each of said bars having a first cutting surface and a second cutting surface; and on each of said bars said second cutting surface being generally parallel to said first cutting surface, but being positioned radially closer to said axle relative to said first cutting surface and also being positioned such that during operation a radially outward tip of said longer hammer element travels an arc that passes in close proximity to said first cutting surface and a radially outward tip of said shorter hammer element travels an arc that passes in close proximity to said second cutting surface so as to shred the materials to be shredded therebetween during use of the apparatus.

* * * * *